US010775115B2

(12) United States Patent
Schaeffer

(10) Patent No.: US 10,775,115 B2
(45) Date of Patent: Sep. 15, 2020

(54) THERMAL SPRAY COATING METHOD AND THERMAL SPRAY COATED ARTICLE

(71) Applicant: GENERAL ELECTRIC COMPANY, Schenectady, NY (US)

(72) Inventor: Jon Conrad Schaeffer, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1247 days.

(21) Appl. No.: 14/013,194

(22) Filed: Aug. 29, 2013

(65) Prior Publication Data

US 2015/0060025 A1 Mar. 5, 2015

(51) Int. Cl.
*C23C 4/18* (2006.01)
*C23C 4/01* (2016.01)
(Continued)

(52) U.S. Cl.
CPC ..... *F28F 13/18* (2013.01); *C23C 4/01* (2016.01); *C23C 4/02* (2013.01); *C23C 4/18* (2013.01); *C23C 28/30* (2013.01)

(58) Field of Classification Search
CPC .. F28F 13/18; F28F 13/187; F28F 1/40; F28F 19/06; F28F 19/02; C23C 28/30;
(Continued)

(56) References Cited

U.S. PATENT DOCUMENTS 3,706,508 A * 12/1972 Moskowitz ..... F01D 5/183 415/115
4,006,999 A * 2/1977 Brantley ..... F01D 5/282 416/224
(Continued)

FOREIGN PATENT DOCUMENTS

EP 0253754 A1 1/1988
EP 1634977 A1 3/2006
(Continued)

OTHER PUBLICATIONS

PCT Search Report and Written Opinion issued in connection with corresponding PCT Application No. PCT/US2014/050497 dated Mar. 5, 2015.
Machine translation and Japanese Office Action issued in connection with Corresponding JP Application No. 2016538948 dated Jun. 5, 2018.

*Primary Examiner* — Dah-Wei D. Yuan
*Assistant Examiner* — Nga Leung V Law
(74) *Attorney, Agent, or Firm* — McNees Wallace & Nurick LLC

(57) ABSTRACT

Thermal spray coating methods and thermal spray coated articles are disclosed. The thermal spray coating method includes positioning a covering on a cooling channel of a component, and thermal spraying a feedstock onto the covering. The covering prohibits the feedstock from entering the cooling channel in the component and is not removed from the component. In another embodiment, the thermal spray coating method includes providing a component comprising a substrate material, providing a cooling channel on a surface of the component, positioning a covering on the cooling channel, and thermal spraying a feedstock onto the component and the covering, the feedstock comprising a bond coat material. The covering prohibits the bond coat material from entering the cooling channel. The thermal spray coated article includes a component, a cooling channel, a covering on the cooling channel, and a thermally sprayed coating on the component and the covering.

20 Claims, 3 Drawing Sheets

(51) Int. Cl.
*C23C 4/02* (2006.01)
*F28F 13/18* (2006.01)
*C23C 28/00* (2006.01)

(58) Field of Classification Search
CPC .. C23C 4/005; C23C 4/02; C23C 4/18; C23C 28/02; C23C 28/07; C23C 28/005; C23C 28/085
USPC ..... 165/133; 427/446, 448, 455, 456
See application file for complete search history.

(56) References Cited

U.S. PATENT DOCUMENTS 4,040,159 A 8/1977 Darrow et al.
5,269,057 A * 12/1993 Mendham ..... B23H 9/10 29/402.08
6,050,777 A 4/2000 Tabbita et al.
6,099,251 A 8/2000 LaFleur
6,394,755 B1 5/2002 Stowell et al.
7,163,718 B2 1/2007 Das et al.
7,371,426 B2 5/2008 Rigney et al.
8,105,030 B2 1/2012 Abdel-Messeh et al.
2002/0106457 A1 8/2002 Lee et al.
2002/0141872 A1 10/2002 Darolia et al.
2005/0118334 A1 6/2005 Gorman et al.
2005/0147764 A1* 7/2005 Bauer ..... C23C 4/00 427/446
2006/0222773 A1 10/2006 Becze et al.
2008/0298975 A1* 12/2008 James ..... B23P 15/04 416/229 A
2010/0075111 A1 3/2010 Arrell et al.
2011/0186550 A1 8/2011 Gannelli et al.
2011/0311369 A1 12/2011 Ramachandran et al.
2012/0156054 A1 6/2012 Lacy et al.
2013/0051979 A1* 2/2013 Durocher ..... F01D 5/08 415/115
2013/0056184 A1 3/2013 Bunker et al.
2014/0199517 A1* 7/2014 Ligon ..... C23C 4/06 428/143

FOREIGN PATENT DOCUMENTS

EP 2100984 A1 9/2009
EP 2423346 A1 2/2012
JP 09277004 A 10/1997
JP 2002004028 A 1/2002

* cited by examiner

THERMAL SPRAY COATING METHOD AND THERMAL SPRAY COATED ARTICLE

FIELD OF THE INVENTION

The present invention is directed to coating methods and coated articles. More particularly, the present invention is directed to thermal spray coating methods and thermal spray coated articles.

BACKGROUND OF THE INVENTION

Components, such as airfoils, cooling fins, and fingers, in various equipment are often subjected to increasingly high temperatures. These high temperatures can typically require a cooling mechanism to reduce component temperature and prevent damage to the component.

One known cooling mechanism includes cooling channels positioned near a hot surface, such as a hot gas path, of a component. In one mechanism, the cooling channels can have a cooling medium in them, such as a gas or a liquid. The cooling medium transports heat away from a region of the component to provide cooling.

In addition to the cooling channels, components are often thermally sprayed with an environmental coating to handle high temperatures. Applying the environmental coating can result in feedstock filling the cooling channels. Filling of the cooling channels can restrict or stop flow of the cooling medium, thereby reducing or eliminating the cooling provided by the cooling mechanism.

A coating method and coated article that do not suffer from one or more of the above drawbacks would be desirable in the art.

BRIEF DESCRIPTION OF THE INVENTION

In an exemplary embodiment, a thermal spray coating method includes positioning a covering on a cooling channel of a component, and thermal spraying a feedstock onto the covering. The covering prohibits the feedstock from entering the cooling channel in the component and is not removed from the component.

In another exemplary embodiment, a thermal spray coating method includes providing a component comprising a substrate material, providing a cooling channel on a surface of the component, positioning a covering on the cooling channel, and thermal spraying a feedstock onto the component and the covering, the feedstock comprising a bond coat material. The covering prohibits the feedstock from entering the cooling channel.

In another exemplary embodiment, a thermal spray coated article includes a component, a cooling channel on a surface of the component, a covering on the cooling channel, and a thermally sprayed coating on the component.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are exemplary thermal spray coating methods and thermal spray coated articles. Embodiments of the present disclosure, in comparison to methods not utilizing one or more features disclosed herein, permit an increase in effectiveness of thermal cooling channels, permit an increase in flow of a cooling medium through the thermal cooling channels, permit an increase in efficiency of thermal spraying, permit a decrease in coating thickness over thermal cooling channels, decrease contamination of thermal cooling channels during thermal spraying, or a combination thereof.

Figure 1:
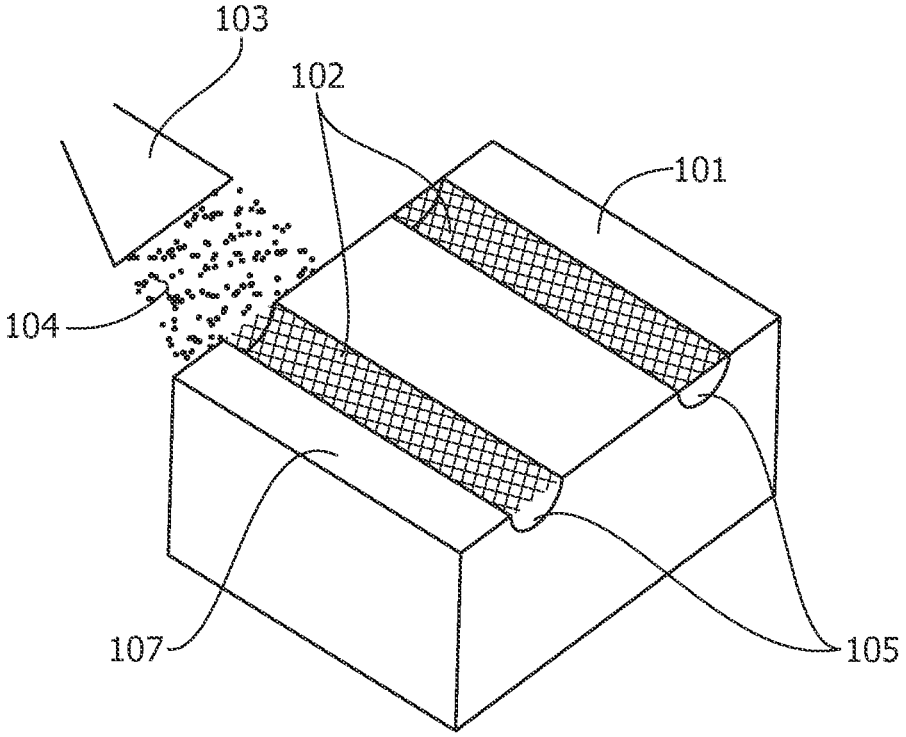
FIG. 1 shows a thermal spray coating method according to an embodiment of the disclosure.

Referring to FIG. 1, in one embodiment, a thermal spray coating method includes positioning a covering 102 on one or more cooling channels 105 in a component 101, and thermal spraying a feedstock 104 onto the component 101 and the covering 102. The covering 102 prohibits the feedstock 104 from entering the cooling channel 105 in the component 101. In one embodiment, the feedstock 104 includes a bond coat material.

Figure 4:
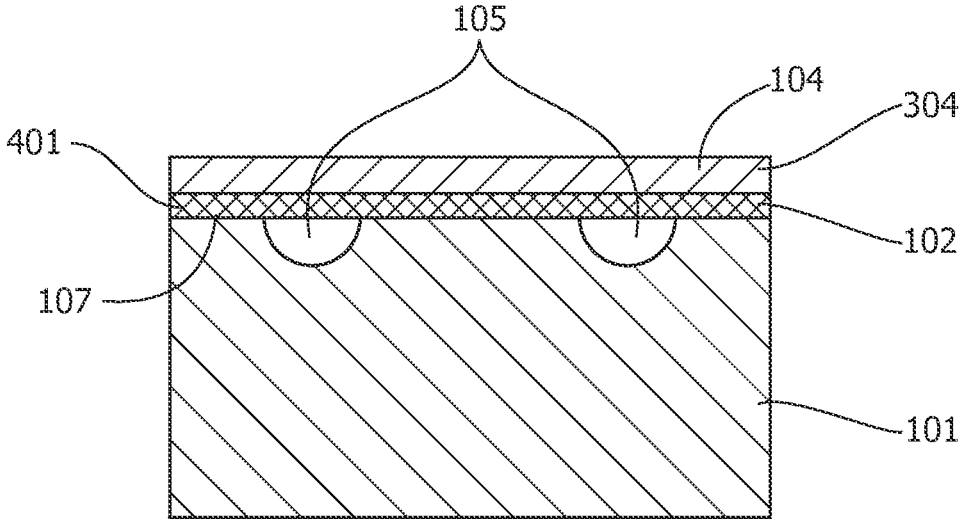
FIG. 4 shows a cross-sectional view corresponding to the article of FIG. 3.

Suitable coverings 102 include, but are not limited to, a mesh, a foil, or a combination thereof. Suitable forms of the covering 102 include, but are not limited to, planar, curved, molded, contoured, complex, a strip, a sheet, or a combination thereof. For example, in one embodiment, the covering 102 is cut into strips and applied over the surface of the component 101, the strips limited to covering the cooling channel 105 (FIG. 1). In another example, the covering 102 is applied over the entire surface of the component 101 (FIG. 4).

As used herein, the term "mesh" refers to an arrangement formed from a pattern of interwoven fibers 203 (FIG. 2), machined interwoven foil, or a combination thereof. Suitable patterns of interwoven fibers 203 include, but are not limited to, plain weave, twill, plain dutch weave, twill dutch, twill dutch double, stranded, or a combination thereof. As used herein, the term "foil" refers to a deformable sheet made of any suitable material. Suitable foil configurations include, but are not limited to, those having openings 204, being devoid of the openings 204, or a combination thereof. The foil is resilient and is resistant to deformation from a thermal spraying nozzle 103. The mesh is pliable, for example, capable of extending around a radius of about 30 mils without structural damage. In one embodiment, the mesh or the foil is selected as the covering 102, and the thermal spraying nozzle 103 is positioned corresponding to the selected material to reduce or eliminate deformation of the covering 102.

In one embodiment, the covering 102 is formed by, for example, electrical discharge machining (EDM), metal injection molding, thin sheet processing, or a combination thereof. The covering 102 is either pre-formed or post-formed. Pre-formed includes forming the covering 102 prior to positioning the covering 102 on the component 101. Post-formed includes forming the covering 102 in position on the component 101. In one embodiment, the covering 102 is temporarily or permanently secured to the component 101. Suitable techniques for the securing of the covering 102 to the component 101 include, but are not limited to, tack welding, plating, sintering, brazing, or a combination thereof.

Suitable compositions of the covering 102 include the substrate material, the bond coat material, or a combination thereof. In one embodiment, the substrate material includes, but is not limited to, cobalt, chromium, tungsten, carbon, nickel, iron, silicon, molybdenum, manganese, alloys thereof, nickel-based alloy, a cobalt-based alloy, superalloys, intermetallics (TiAl and/or NiAl), ceramic matrix composites, or a combination thereof. In one embodiment, the bond coat material includes, but is not limited to, $Ba_{1-x}Sr_xAl_2Si_2O_8$ (BSAS), ceramic oxides, $(Yb,Y)_2Si_2O_7$, mullite with BSAS, Silicon and/or Yttrium mono and/or disilicates, or a combination thereof.

A suitable nickel-based alloy for use as the substrate material includes, by weight, about 14% chromium, about 9.5% cobalt, about 3.8% tungsten, about 1.5% molybdenum, about 4.9% titanium, about 3.0% aluminum, about 0.1% carbon, about 0.01% boron, about 2.8% tantalum, and a balance of nickel and incidental impurities.

Another suitable nickel-based alloy includes, by weight, about 7.5% cobalt, about 9.75% chromium, about 4.20% aluminum, about 3.5% titanium, about 1.5% molybdenum, about 4.8% tantalum, about 6.0% tungsten, about 0.5% columbium (niobium), about 0.05% carbon, about 0.15% hafnium, about 0.004 percent boron, and the balance nickel and incidental impurities.

Another suitable nickel-based alloy for use as the substrate material includes, by weight, between about 0.07% and about 0.10% carbon, between about 8.0% and about 8.7% chromium, between about 9.0% and about 10.0% cobalt, between about 0.4% and about 0.6% molybdenum, between about 9.3% and about 9.7% tungsten, between about 2.5% and about 3.3% tantalum, between about 0.6% and about 0.9% titanium, between about 5.25% and about 5.75% aluminum, between about 0.01% and about 0.02% boron, between about 1.3% and about 1.7% hafnium, up to about 0.1% manganese, up to about 0.06% silicon, up to about 0.01% phosphorus, up to about 0.004% sulfur, between about 0.005% and about 0.02% zirconium, up to about 0.1% niobium, up to about 0.1% vanadium, up to about 0.1% copper, up to about 0.2% iron, up to about 0.003% magnesium, up to about 0.002% oxygen, up to about 0.002% nitrogen, balance nickel and incidental impurities.

Figure 2:
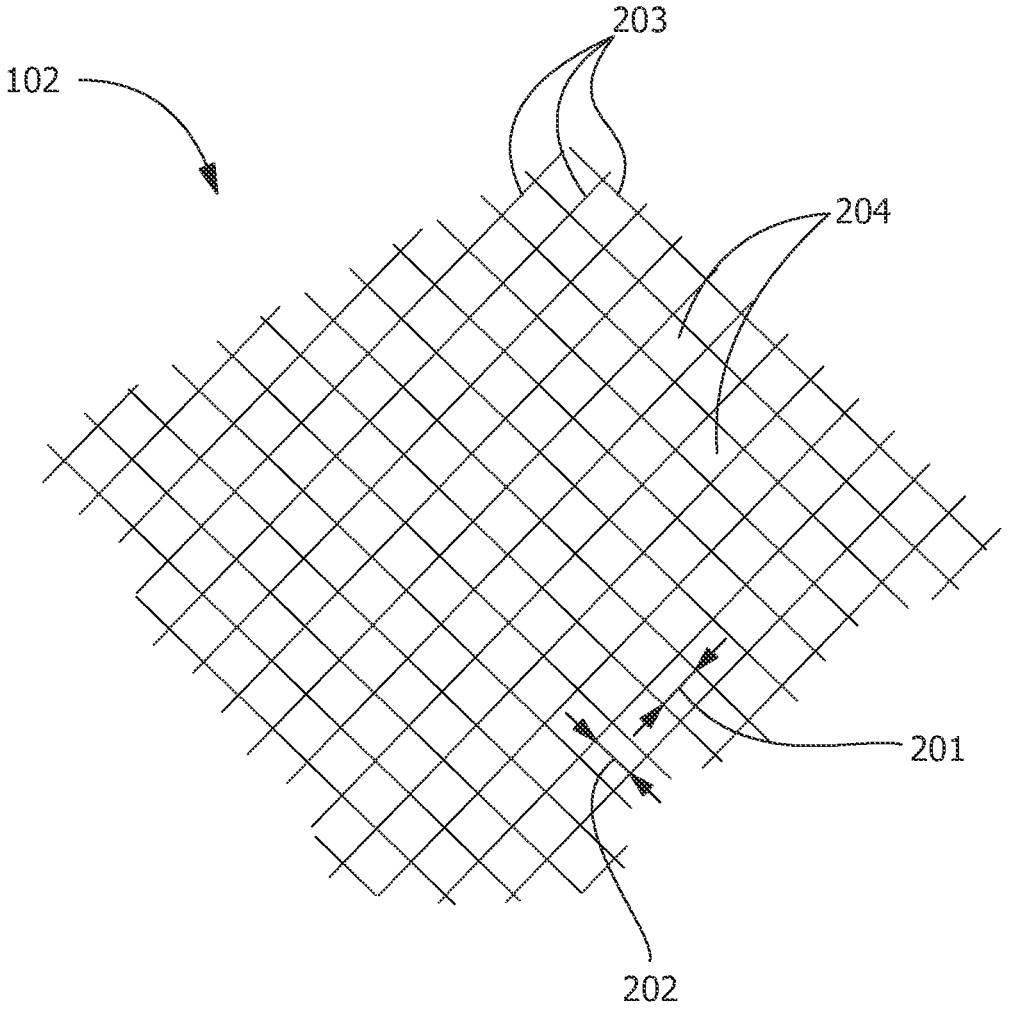
FIG. 2 shows a mesh covering according to an embodiment of the disclosure.

Referring to FIG. 2, in one embodiment, the openings 204 in the covering 102 have a first dimension, such as a first width 201, and a second dimension, such as a second width 202. The first width 201 and the second width 202 at least partially define a predetermined area. The predetermined area of the openings 204 in the covering 102 is smaller than minimum dimensions, such as a minimum width of the feedstock 104, such that the feedstock 104 is unable to pass through the openings 204. The feedstock 104 is directed towards and sprayed onto the component 101, through the thermal spraying nozzle 103. The smaller area of the opening 204 in the covering 102 prevents the feedstock 104 from passing through the covering 102. In one embodiment, the pattern of the interwoven fibers 203 in the mesh forms the openings 204 in the covering 102. In another embodiment, the openings 204 in the covering 102 are formed by machining of the covering 102.

Suitable dimensions of the opening 204 correspond to a particle size of the feedstock 104. In one embodiment, the dimensions are, for example, less than 50 μm, between approximately 3 μm and approximately 50 μm, between approximately 3 μm and approximately 5 μm, between approximately 45 μm and approximately 55 μm, or any combination, sub-combination, range, or sub-range thereof.

Thermal spraying melts the feedstock 104 and forms molten droplets having a predetermined dimension. The molten droplets are accelerated towards and contact the component 101. The molten droplets flatten upon contact with the component 101. Suitable predetermined dimensions of the feedstock 104 include, but are not limited to, between approximately 2 μm and approximately 50 μm, between approximately 5 μm and approximately 45 μm, between approximately 15 μm and approximately 35 μm, between approximately 2 μm and approximately 30 μm, between approximately 2 μm and approximately 10 μm, between approximately 5 μm and approximately 15 μm, between approximately 10 μm and approximately 20 μm, between approximately 20 μm and approximately 30 μm, between approximately 30 μm and approximately 40 μm, between approximately 40 μm and approximately 50 μm, or any combination, sub-combination, range, or sub-range thereof.

Figure 3:
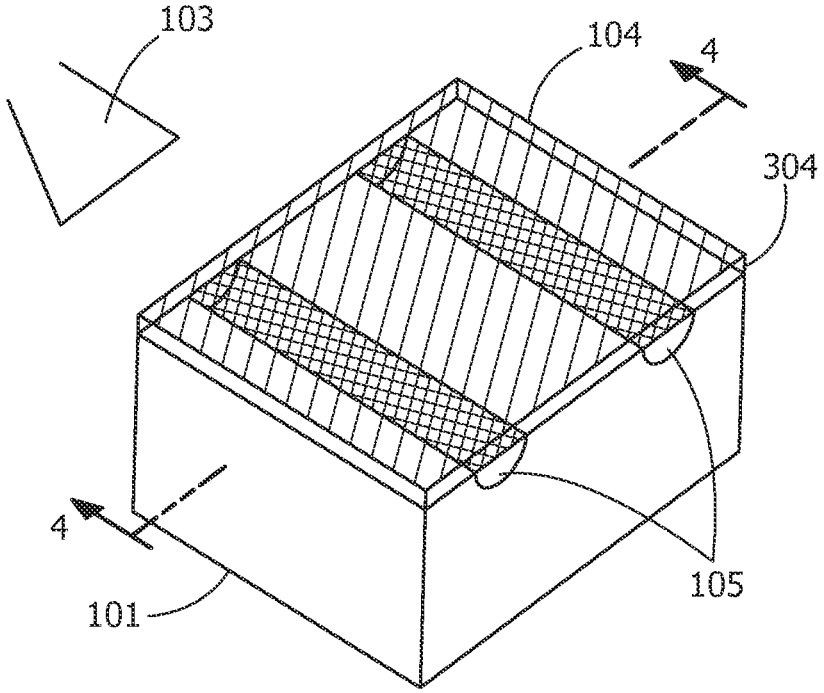
FIG. 3 shows a perspective view of an article coated by a thermal spray coating method according to an embodiment of the disclosure.

Referring to FIG. 3, the thermal spraying of the feedstock 104 forms a coating 304 over the component 101. In one embodiment, the covering 102 forms a continuous layer 401 (FIG. 4) between the component 101 and the coating 304, as is shown in section A-A of FIG. 4. In one embodiment, the covering 102 forms a discontinuous layer between the component 101 and the coating 304, as is shown in FIG. 1. The covering 102 is melted, decomposed, oxidized, microstructurally modified, destroyed by the thermal spraying, maintained intact, or other suitable combinations thereof. The covering 102 may no longer be present as a defined layer between the component 101 and the coating 304, may remain as a separate layer between the component 101 and the coating 304, or any suitable combination thereof.

The component 101 is any suitable article or portion of an article, for example, an airfoil, a cooling fin, a finger, a hot-gas-path member, or a combination thereof. Hot-gas-path members are gas turbine members exposed to a combustion process and/or to hot gases discharged from a combustion reaction. Suitable hot-gas-path members include, but are not limited to, a combustion liner, an end cap, a fuel nozzle assembly, a crossfire tube, a transition piece, a turbine nozzle, a turbine stationary shroud, a turbine bucket (blade), turbine disks, turbine seals, or a combination thereof. In one embodiment, the component 101 is capable of withstanding harsh conditions, for example, temperatures of between about 1500° F. and about 2600° F., between about 1500° F. and about 2100° F., between about 2100° F. and about 2600° F., between about 1800° F. and about 2300° F., between about 2000° F. and about 2400° F., or any suitable range, sub-range, combination, or sub-combination thereof.

To prevent heat damage to the component 101, in one embodiment, the cooling channel 105 is provided on a surface 107 of the component 101. In a further embodiment, the cooling channel 105 includes a cooling fluid such as, but not limited to, a gas, a liquid, a refrigerant, or a combination thereof. Suitable embodiments of the cooling channel 105 include, but are not limited to, semi-circular, rectangular, triangular, linear, curved, complex, intersecting, parallel, or a combination thereof. The covering 102 prohibits the feedstock 104 from entering the cooling channel 105 during thermal spraying, causing the coating 304 to form over the cooling channel 105 and the covering 102. The coating 304 over the cooling channel 105 prohibits the cooling fluid from escaping the cooling channel 105.

A thickness of the coating 304 over the cooling channels 105 controls a heat transfer rate of the cooling medium. A decrease in the thickness of the coating 304 increases a cooling rate of the cooling channel 105. Suitable thicknesses of the coating 304 include, but are not limited to, between approximately 150 μm and approximately 4,000 μm, between approximately 300 μm and approximately 1,000 μm, between approximately 200 μm and approximately 800 μm, between approximately 150 μm and approximately 250 μm, between approximately 500 μm and approximately 1,500 μm, or any combination, sub-combination, range, or sub-range thereof.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A thermal spray coating method, comprising:

positioning a covering, having a plurality of openings through the covering, on a cooling channel of a component; and then thermal spraying a feedstock onto the covering;

wherein the covering prohibits the feedstock from entering the cooling channel in the component and is not removed from the component; and wherein the plurality of openings have dimensions less than 50 μm.

2. The method of claim 1, wherein the thermal spraying applies a coating over the covering and a substrate of the component.

3. The method of claim 2, further comprising transporting a cooling medium through the cooling channel after thermal spraying the feedstock onto the covering, wherein the transporting is devoid of leakage through the coating.

4. The method of claim 1, further comprising securing the covering to the component.

5. The method of claim 1, further comprising tack welding the covering to the component.

6. The method of claim 1, further comprising forming the covering prior to the positioning of the covering.

7. The method of claim 1, wherein the positioning of the covering comprises forming the covering in position on the component.

8. The method of claim 1, further comprising forming the covering from electrical discharge machining.

9. The method of claim 1, further comprising forming the covering from metal injection molding.

10. The method of claim 1, further comprising melting the covering by the thermal spraying.

11. The method of claim 1, wherein the covering is a mesh formed from a pattern of interwoven fibers selected from the group consisting of plain weave, twill, plain dutch weave, twill dutch, twill dutch double, stranded, or a combination thereof.

12. The method of claim 1, wherein the covering is a foil.

13. The method of claim 1, wherein the component is selected from the group consisting of an airfoil, a cooling fin, a finger, a combustion liner, an end cap, a fuel nozzle assembly, a crossfire tube, a transition piece, a turbine nozzle, a turbine stationary shroud, a turbine bucket, or a combination thereof.

14. The method of claim 1, wherein the thermal spraying of the feedstock applies the feedstock to a portion of the component.

15. The method of claim 1, wherein the thermal spraying of the feedstock applies the feedstock only to the covering.

16. A thermal spray coating method, comprising:

providing a component comprising a substrate material; and providing a cooling channel on a surface of the component; then positioning a covering, having a plurality of openings through the covering, on the cooling channel; and then thermal spraying a feedstock onto the component and the covering, the feedstock comprising a bond coat material;

wherein the covering prohibits the feedstock from entering the cooling channel.

17. The method of claim 16, wherein the covering includes the substrate material.

18. The method of claim 16, wherein the covering includes the bond coat material.

19. A thermal spray coated article, comprising:

a hot-gas-path member of a gas turbine;

a cooling channel on a surface of the hot-gas-path member;

a covering, having a plurality of openings through the covering, on the cooling channel; and a thermally sprayed coating on the hot-gas-path member and the covering;

wherein the thermally sprayed coating prohibits a cooling fluid in the cooling channel from escaping the cooling channel; and wherein the covering prohibits a feedstock of the thermally sprayed coating from entering the cooling channel.

20. The method of claim 1, wherein the dimensions of the openings are smaller than a predetermined dimension of molten droplets of the feedstock such that the feedstock is unable to pass through the openings.

* * * * *